United States Patent [19]

Bates

[11] 4,227,558

[45] Oct. 14, 1980

[54] APPARATUS FOR SIMULATING A WOODGRAIN FINISH

[76] Inventor: Robert E. Bates, 161 Portland Rd., Remuera, Auckland, New Zealand

[21] Appl. No.: 972,457

[22] Filed: Dec. 22, 1978

[30] Foreign Application Priority Data

Dec. 22, 1977 [NZ] New Zealand ..... 186093

[51] Int. Cl.[3] ..... B27C 9/00

[52] U.S. Cl. ..... 144/2 R; 144/309 F; 144/327

[58] Field of Search ..... 144/2 R, 3 R, 309 R, 144/309 F, 309 Z, 327, 328; 427/223, 227; 428/174

[56] References Cited

U.S. PATENT DOCUMENTS

| | | | |
|---|---|---|---|
| 922,026 | 5/1909 | Nishimura | 144/327 |
| 1,758,336 | 5/1930 | Schmid | 144/309 F |
| 3,028,622 | 4/1962 | Park | 427/223 |
| 3,110,607 | 11/1963 | McElroy | 427/227 |

*Primary Examiner*—W. Donald Bray
*Attorney, Agent, or Firm*—Murray & Whisenhunt

[57] ABSTRACT

An apparatus to simulate a woodgrain finish on composite wooden sheet material. The apparatus comprises a plurality of burner heads coupled to a gas supply and each having a row of transversely disposed nozzles. The burner heads are mounted on transversely disposed rods longitudinally reciprocated in their mountings. Reciprocation of the rods is by a cam associated with each rod, the cams being of different profiles and/or timing relative to one another. With ignition of the nozzles corresponding carbonization scorch lines are formed on the surface of the sheet as the sheet is passed through the apparatus. The reciprocal action of the burner support rods imparts a substantially wavy motion to the lines, a random wave pattern resulting from the varying profiles and timing of the cams. The scorching results in minimal charring and the surface is finish sanded to remove raised smut.

3 Claims, 3 Drawing Figures

APPARATUS FOR SIMULATING A WOODGRAIN FINISH

BACKGROUND OF THE INVENTION

This invention relates to a method and an apparatus for simulating a woodgrain finish on sheet material, for example, and in particular on composite wooden boards or sheets.

SUMMARY OF THE INVENTION

The intention of this invention is to enable a variety of simulated woodgrain finishes of random pattern to be readily applied to otherwise plain composite wooden boards or sheets to enhance the aesthetic appearance thereof. It is found that the method and apparatus in particularly suitable for forming a dark simulated mahogany finish. The cost involved is considerably less than applying a veneer to a backing sheet. The finished product, particularly when treated with suitable finishing compositions, for example, stains and/or polyurethene varnish, is particularly suitable for use in the construction of interior cupboard fittings, furniture and similar units.

According to one aspect of this invention there is provided a simulated woodgrain embellishing apparatus comprising at least one burner head mounted adjacently above a substantially horizontally disposed sheet or board material conveyor support bed and incorporating a plurality of transversely and adjacently spaced apart outlet nozzles directed toward the support bed, fuelling means coupled to the burner head to provide for a naked flame issuing from each nozzle and means to repetitively alter the transverse position of the nozzles relative to the bed.

According to a second aspect of this invention there is provided a method of simulating a woodgrain finish on an essentially wooden composite sheet or board comprising the steps of passing the sheet or board through the apparatus defined in the preceding paragraph, igniting the nozzles such that the resultant jet flames essentially scorch but not char except minimally the upper surface of the sheet so as to at least partially discolour said surface as the board passes through the apparatus and then finish sanding the surface to remove smut so formed and raised from the surface.

DETAILED DESCRIPTION OF THE INVENTION

Figure 2:
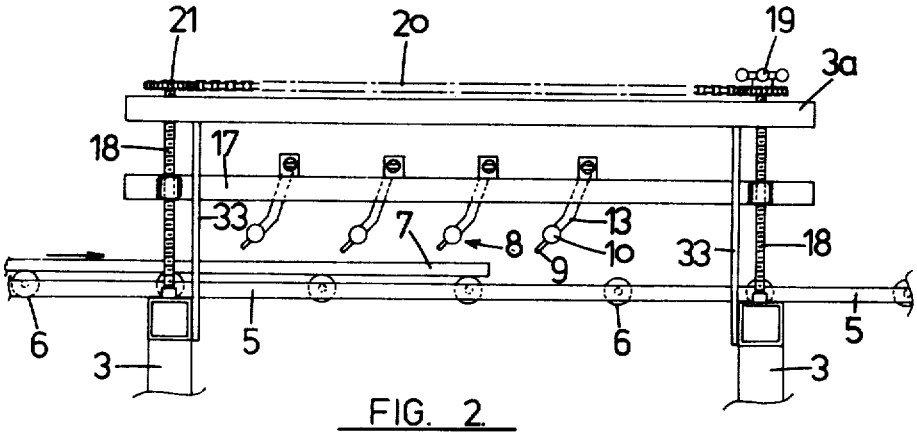
FIG. 2 is a side elevation of the apparat in the direction of arrow A on FIG. 1 with cam gear on the near-side and fuel feed lines removed for clarity.

Referring in particular to FIG. 2, a bench high frame 3 is preferably formed from box section steel or similar material. Frame 3 incorporates a pair of parallel lateral runners 5 which support a plurality of spaced apart transverse rollers 6 which form a bed for the passage of a work piece through the apparatus. Preferably runners 5 extend outwardly of each end of the apparatus thereby adapting the apparatus to form part of a production chain. A work piece 7 conventionally a sheet of wooden composite material can be passed through the apparatus on the rollers 6.

Figure 1:
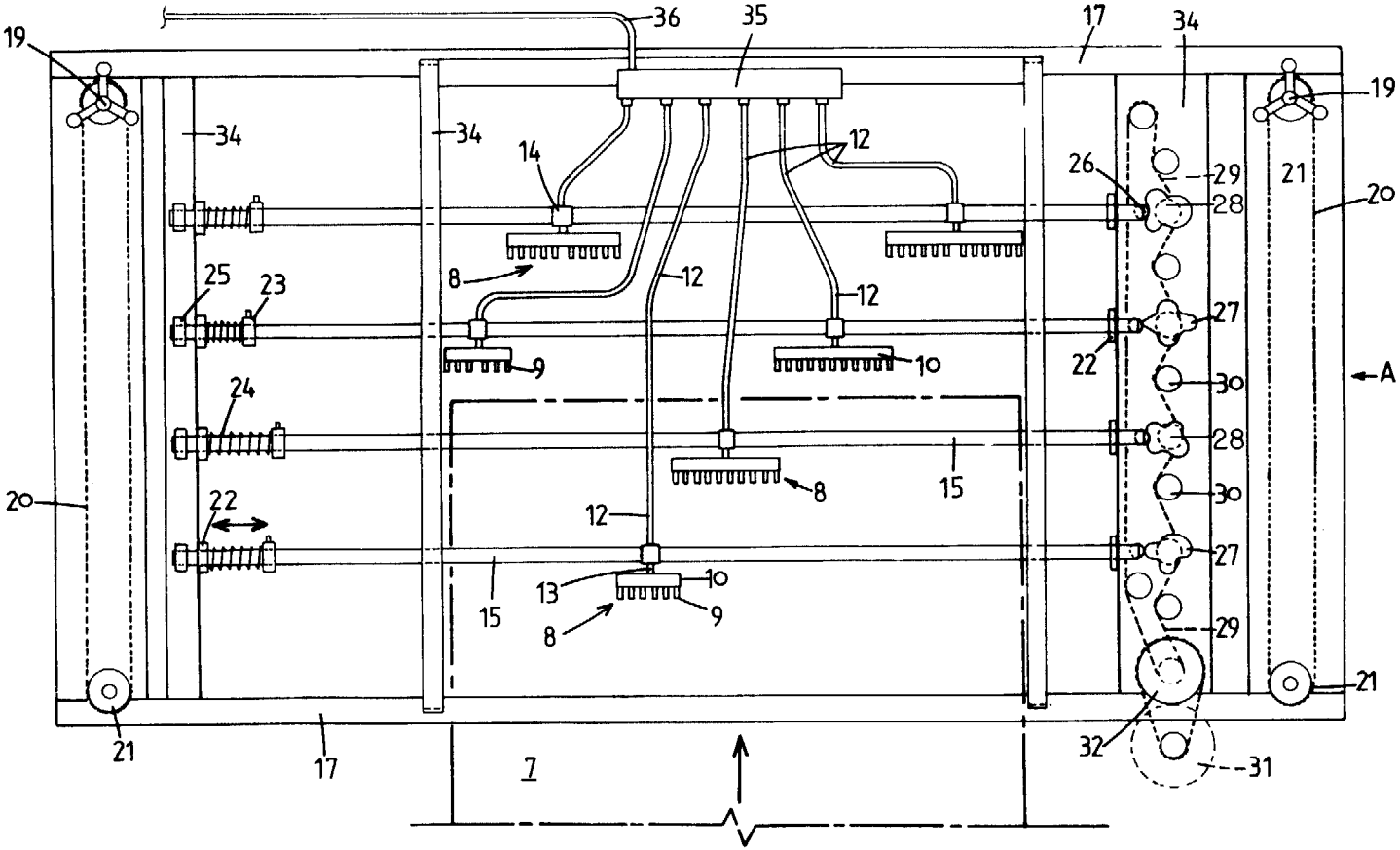
FIG. 1 is a plan view of the apparatus depicting in particular a main carriage thereof, a sheet being processed being depicted schematically relative thereto and an upper section of the main frame being removed for purposes of clarity.

Adjacent each corner of the frame 3 an upright 33 is provided to support a sub-frame 3*a* comprising a horizontally disposed rectangular frame extending in substantially parallel relationship over the conveyor bed. Adjacent each upright 33 a worm screw 18 is mounted to adjustibly support a carriage 17 between main frame 3 and sub-frame 3*a*. Worm screws 18 are mounted for free rotation at their upper and lower ends to sub-frame 3*a* and main frame 3 respectively whereby rotation of the worm screws 18 raises and lowers carriage 17. Preferably one worm screw 18 at each side of the apparatus incorporates a turn handle 19 with the worm screws 18 at that side being interconnected by a continuous chain 20 extending about the sprockets 21 fixed to each worm screw 18 to transmit the rotation of turn handle 19. Referring in particular to FIG. 1, carriage 17 is of a rectangular configuration with the longer axis disposed transversely of the apparatus. Carriage 17 incorporates four longitudinal, relative to the apparatus, braces 34 which slidingly support transverse rods 15 at longitudinal spaced apart intervals. Each rod 15 is mounted adjacent its ends and bearings 22 mounted to carriage 17 and in which each rod 15 can be longitudinally reciprocated. To this end, adjacent one set of ends of the rods 15 each rod incorporates a stop 23 mounted inwardly of the corresponding bearing 22 with a compression spring 24 retained therebetween. At the adjacent end of the rod 15 outwardly of bearing 22 a second stop is provided.

At the opposing end each rod 15 incorporates a cam roller 26 which impinges onto a cam 27 mounted in juxtaposition thereto. Rotation of the cam 27 provides for the reciprocating repetitive action of the associated rod 15 and thus a corresponding transverse alteration of the position of a burner head 8 mounted on rod 15 relative to a work piece 7 as described in more detail hereinafter.

The brace 34 at the cam 27 end of the rods 15 incorporates a horizontally disposed plate section upwardly of which stub axles 28 extend to rotationally support each cam 27 adjacent the end of the associated rod 15. A common drive chain 29 engages with a sprocket section of each cam 27 and intermediate idler sprockets 30 to provide for rotation of each cam 27. Preferably chain 29 is driven by a variable drive pneumatic motor 31 operating through reduction sprockets 32 and also mounted the carriage 17.

Preferably the profile of the cams 27 differ from one another and/or are arranged out of phase with one another such that the reciprocating action imparted thereby to each rod 15 is substantially random relative to the corresponding actions of the other rods 15.

At least one burner head 8 is mounted to each rod 15. The burner heads 8 are mounted in staggered relationship, as particularly shown on FIG. 1, to thus cover the full width of a work piece on the conveyor bed, the burner heads 8 marginally overlapping to varying degrees dependent upon the timing of the cams 27.

Each burner head 8 preferably comprises a transversely, relative to the work piece 7, and horizontally disposed, hollow tubular element 10 closed at each end. Therealong a row of apertures is formed in which radially extending nozzles 9 are mounted to direct flame jets 33 onto the work piece 7. An inlet spigot-like connection 11 is provided centrally of each element 10 to which a flexible hose 12 is attached to conjoin each burner head 8 to a fuel supply. Preferably each hose 12 conjoins with a manifold 35 mounted on carriage 17 and from which a common fuel line 36 extends.

Figure 3:
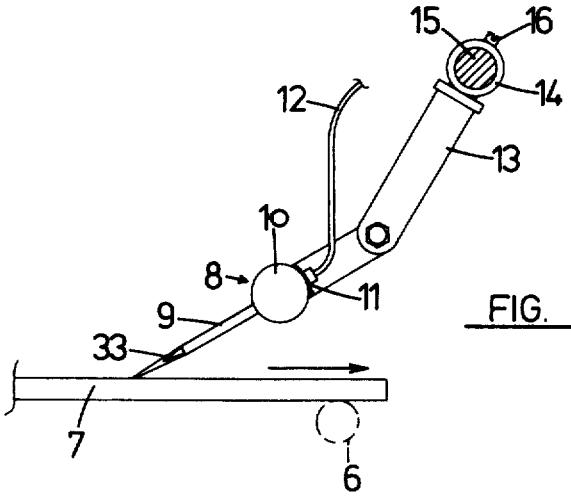
FIG. 3 is an enlarged side elevation of a burner head depicted schematically relative to a work piece being processes by the apparatus.

Referring in particular to FIG. 3, each burner head 8 is preferably mounted to the associated rod 15 by way of an elbowed arm 13. Burner head element 10 is mounted to the lower end of arm 13 and the upper end thereof incorporates a mounting bush 14 which is clamped to rod 15 by a locking grub screw 16. Such mounting is thus adjustable both radially and longitudinally of rod 15 which together with the elbowed nature of arm 13 enables the ready alteration of the spacing and inclination of the nozzles 9 relative to a work piece 7.

Fuel, preferably a mixture of acetylene and compressed air and/or oxygen is fed by hoses 12 to the burner heads 8. Ignition of the gas at the nozzles 9 provides for jet flames 33 directed onto the upper surface of a work piece 7 such that each flame 33 scorches the upper surface thereof. The scorching partially discolours by carbonisation of that surface. The discolouration is in the form of longitudinally extending wavy lines corresponding to each flame 33, the wavy nature stemming from the reciprocating action of supporting rods 15. The intensity and penumbra characteristics of the scorching and thus the degree of discolouration can be controlled by altering the conveying speed of the work piece 7 through the apparatus, the gas constitution, and the inclination and spacing of each flame 33 relative to the work piece 7. Such control of the apparatus is also exercised to meet the characteristics of work pieces 7 formed from different materials depending upon primarily their combustibility.

In utilising the apparatus an essentially wooden composite sheet or board 7 is fed therethrough at a speed, flame intensity and physical disposition to provide a degree of scorching considered desirable to simulate a pronounced or otherwise woodgrain finish thereon. Thereafter the so scorched surface is finish sanded to remove so formed and raised smut. Such step is not an essential step of the process and, as stated, is merely a finishing step in the same sense as is conventionally used in good craftmanship particularly prior to application of a stain and/or lacquer coating. It is found that in this process such a final coating particularly enhances the surface embellished by the scorching as aforesaid.

What I claim is:

1. A simulated woodgrain embellishing apparatus, comprising:

(a) a frame;

(b) a plurality of rollers supported by said frame and forming a horizontally disposed workpiece support bed;

(c) a carriage substantially horizontally disposed adjacently over said workpiece support bed;

(d) a plurality of transverse burner head supports mounted on said carriage transversely one behind the other relative to the path of said workpiece support bed, each of said burner head supports being longitudinally reciprocable within support bearings mounted on said carriage;

(e) cam means operatively connected to each of said burner head supports to effect longitudinal reciprocal movement of said burner head supports;

(f) means for rotating said cam means to effect said reciprocal movement of said burner heads supports;

(g) burner heads mounted, at least one to each of said burner head supports, in transverse staggered relationship to each other, each burner head having a plurality of transversely disposed and adjacently spaced apart nozzles spaced adjacently upward of and directed toward said workpiece support bed;

(h) means for fueling said burner heads to form, upon ignition, a naked flame issuing from each nozzle to scorch an upper surface of a workpiece passing through the apparatus on said workpiece support bed to produce a simulated woodgrain appearance.

2. A simulated woodgrain embellishing apparatus as claimed in claim 1, wherein each burner head support comprises a rod having a first end and a second end, each of said first ends having a stop mounted inwardly of a respective bearing with a compression spring retained between said stop and said respective bearing, each of said second ends having a cam roller operatively engageable with a respective cam means, the profiles of each of said cam means differing from one another, whereby a reciprocating action is imparted to a rod by a respective cam means which is substantially random relative to corresponding reciprocating actions of the remaining rods, said transverse staggered relationship of said burner heads providing that, from time to time, they marginally overlap as a result of said random reciprocating action of said rods.

3. A simulated woodgrain embellishing apparatus as claimed in claim 1, wherein each burner head support comprises a rod having a first end and a second end, each of said first ends having a stop mounted inwardly of a respective bearing with a compression spring retained between said stop and said respective bearing each of said second ends having a cam roller operatively engagable with a respective cam means, the profiles of each of said cam means being arranged out of phase with one another, whereby a reciprocating action is imparted to a rod by a respective cam means which is substantially random relative to corresponding reciprocating actions of the remaining rods, said transverse staggered relationship of said burner heads providing that, from time to time, they marginally overlap as a result of said random reciprocating action of said rods.

* * * * *